US008245466B2

(12) United States Patent
Wright

(10) Patent No.: US 8,245,466 B2
(45) Date of Patent: Aug. 21, 2012

(54) WALL FRAMING STUD AND WALL FRAMING SYSTEM

(75) Inventor: William Arthur Wright, Carmel, IN (US)

(73) Assignee: Innovative Building Concepts, Inc., Hartford City, IN (US)

( * ) Notice: Subject to any disclaimer, the term of this patent is extended or adjusted under 35 U.S.C. 154(b) by 0 days.

(21) Appl. No.: 12/834,064

(22) Filed: Jul. 12, 2010

(65) Prior Publication Data

US 2010/0275548 A1 Nov. 4, 2010

Related U.S. Application Data

(63) Continuation-in-part of application No. 12/190,305, filed on Aug. 12, 2008, now abandoned, which is a continuation of application No. 11/199,502, filed on Aug. 9, 2005, now abandoned.

(51) Int. Cl.
*E04H 5/00* (2006.01)

(52) U.S. Cl. ..... 52/241; 52/579

(58) Field of Classification Search ..... 52/241, 52/579, 242, 741, 236.7, 733.2
See application file for complete search history.

(56) References Cited

U.S. PATENT DOCUMENTS

| | | | |
|---|---|---|---|
| 2,067,403 | A | 1/1937 | Lea |
| 2,132,832 | A | 10/1938 | Prive |
| 2,138,291 | A | 11/1938 | Callaghan |
| 2,241,338 | A | 5/1941 | Balduf |
| 2,350,093 | A | 5/1944 | Braloff |
| 4,050,205 | A | 9/1977 | Ligda |
| 4,222,211 | A | 9/1980 | Pearson |
| 4,478,018 | A | 10/1984 | Holand |
| 4,555,889 | A | 12/1985 | Mankowski |
| 4,805,364 | A | 2/1989 | Smolik |
| 4,866,899 | A | 9/1989 | Houser |
| 4,914,879 | A | 4/1990 | Goldberg |
| 5,277,005 | A | 1/1994 | Hellwig et al. |
| 5,313,752 | A | 5/1994 | Hatzinikolas |
| 5,325,651 | A | 7/1994 | Meyer et al. |
| 5,394,665 | A | 3/1995 | Johnson |
| 5,499,480 | A | 3/1996 | Bass |
| 5,596,859 | A | 1/1997 | Horton et al. |
| 7,073,302 | B2 | 7/2006 | Burg |
| 7,386,961 | B2 | 6/2008 | Ressler |

*Primary Examiner* — Jeanette E Chapman
*Assistant Examiner* — Daniel Kenny
(74) *Attorney, Agent, or Firm* — Bruce J. Bowman

(57) ABSTRACT

A framing system for a new or existing wall, structure and/or the like is provided that uses just one type of unit or member for various framing applications, namely serving as a framing stud and framing plate or track—i.e. a universal framing unit. The universal framing unit is formed from a single piece of metal as a three-wall member having a front wall, a first lateral wall, and a second lateral wall. The first lateral wall is continuous with a first lateral side of the front wall via a first curved transition so as to be generally perpendicular relative to the front wall, while the second lateral wall is continuous with a second lateral side of the front wall via a second curved transition so as to be generally perpendicular relative to the front wall. A first slot is formed in the first curved transition and extends from a first end of the universal framing unit a first length along the first curved transition. A second slot is formed in the second curved transition and extends from the first end of the universal framing unit a second length along the second curved transition. A notch may be provided at the junction of the slot and the respective lateral wall to create a wider entrance to the slot. Preferably, the second end of the universal framing unit has the same first and second slot configurations in the first and second curved transitions.

20 Claims, 16 Drawing Sheets

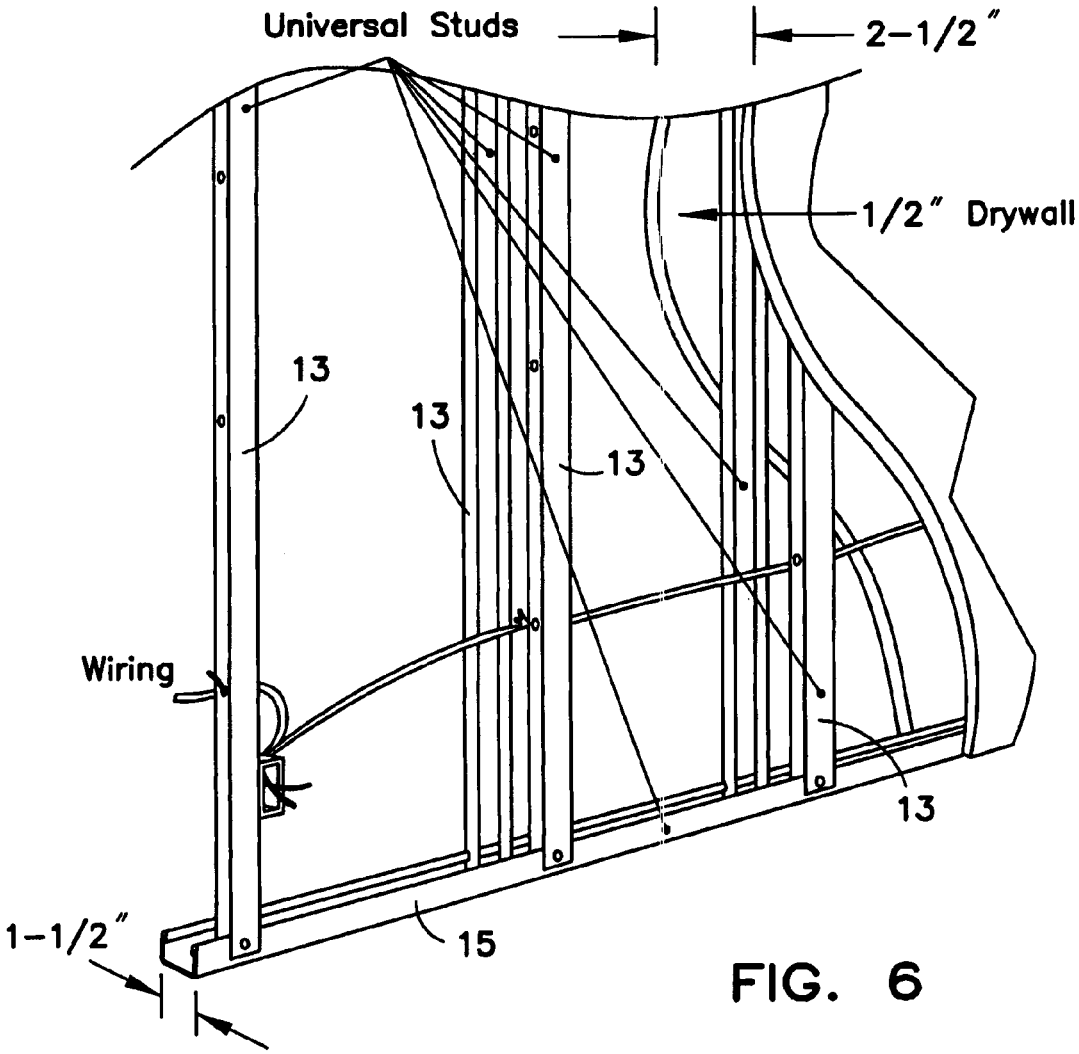
FIG. 6
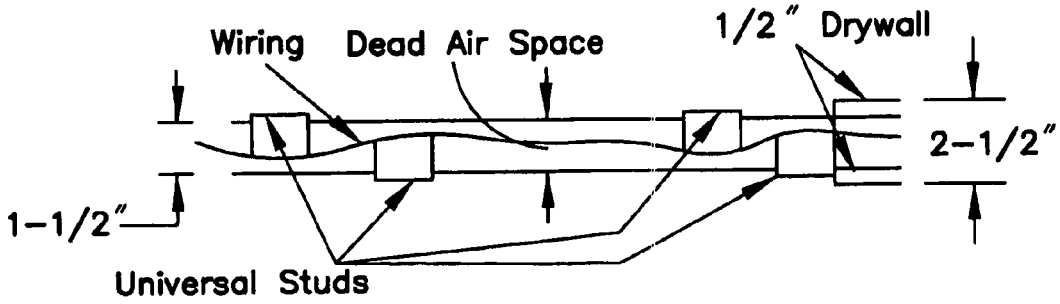
Top View

WALL FRAMING STUD AND WALL FRAMING SYSTEM

RELATED APPLICATIONS

This patent application is a continuation-in-part of U.S. patent application Ser. No. 12/190,305 filed Aug. 12, 2008 now abandoned entitled "Universal Stud" which was a continuation of now abandoned U.S. patent application Ser. No. 11/199,502 filed Aug. 9, 2005 entitled "Universal Stud" which claims, and thus this application claims, the benefit of and/or priority to U.S. Provisional Patent Application Ser. No. 60/591,371 entitled "Universal Stud" the entire contents of all of which is specifically incorporated herein by this reference.

BACKGROUND OF THE INVENTION

1. Field of the Invention

The present invention relates generally to the field of wall framing and particularly to specific areas and jobs of framing that the ordinary "C" stud has a problem doing or can not do physically.

2. Background Information

Presently, the art of wall framing systems is rendered inefficient in several respects. Many of these inefficiencies arise from the limitations of the standard "C" stud as well as other prior art studs and/or stud systems. At the present time, the standard "C" stud is designed to make straight walls 4½" thick with only metal electrical conduit running through it. The standard "C" stud system needs special studs and tools to complete most framing projects.

These are the non-exclusive framing areas in which the standard "C" stud must have special studs/studding and/or tools on the job site in order to properly frame them, namely: A) sound proofing the walls; B) creating curves laterally (horizontally); C) creating curves vertically; D) creating curves both laterally and vertically at the same time; E) creating 2½ finished walls wherein wires can be run and at the same time be sound proof; F) creating any thickness walls that can curve or angle or go straight independent of the other side of the wall; G) create remodeled walls that an be extended to make contact with both the floor and the ceiling; H) create braces and supports easily; I) easily install wires after the wall has been completed; J) fur-out walls only using 2" of floor space and still run electrically wires; K) install 1½" drain lines in the standard 4½" thick walls; L) run electrical, pipes, computer, security, sound and telephone through the chases in the wall; M) easily attach rough-in fixtures to the interior of the walls using only zip ties; and N) creating bulkheads and unusual wall configurations.

It is thus apparent from the above that there is a need for a stud and/or stud system that can perform the above framing tasks.

It is thus further apparent from the above that there is a need for a stud and/or stud system that can accomplish the fourteen jobs set forth above.

It is thus even further apparent from the above that there is a need for a stud and/or stud system that can accomplish at least the fourteen jobs set forth above.

SUMMARY OF THE INVENTION

The present invention is a framing unit having universal framing applications that can complete all of the fourteen framing tasks listed above—both as a framing stud and a framing plate or track. The universal framing unit is smaller in width and depth than a full dimension framing stud (i.e. one that spans the entire depth of a wall or partition) and includes a slot configuration on both ends thereof. The present universal framing unit provides flexibility in manipulation thus providing flexibility in framing.

The universal framing unit is formed from a single piece of metal as a three-wall member having a front wall, a first lateral wall, and a second lateral wall. The first lateral wall is continuous with a first lateral side of the front wall via a first curved transition so as to be generally perpendicular to the front wall, while the second lateral wall is continuous with a second lateral side of the front wall via a second curved transition so as to be generally perpendicular to the front wall. A first slot is formed in the first curved transition and extends from a first end of the universal framing unit a first length along the first curved transition. A second slot is formed in the second curved transition and extends from the first end of the universal framing unit a second length along the second curved transition. Preferably, but not necessarily, the second end of the universal framing unit has the same first and second slot configurations in the first and second curved transitions.

The first and second slots of one or both ends of the universal framing unit are preferably, but not necessarily, wider at the end(s) of the framing unit to provide configured slots (see e.g. FIGS. 1-5). Such width is provided by an angled cut, notch or cutout that extends from an end of the respective lateral side wall to the slot. This allows the framing unit ends to be slid easily over the walls of the universal framing unit used as a plate (see, e.g. FIGS. 1-6). The slots allow the universal framing unit to be extended to meet the ceiling heights.

In one form, the universal framing unit as a framing stud is much smaller than standard studs, measuring 1½" one direction and 1" in the other direction but comes in the same lengths that standard studs come in (e.g. eight and ten feet). In the middle of the 1½" side and at each end of the universal unit is preferably, but not necessarily, a pre-drilled hole (see, e.g. FIGS. 1-3) in order to make it user friendly to screw the universal framing unit as a stud to the universal framing unit as a plate (see, e.g. FIGS. 1-7). Along each open side of the universal framing unit, the metal is hemmed over (see, e.g. FIGS. 1-4) to both give the universal framing unit strength and leave smooth edges along which the wiring run without the wiring being cut.

Additionally, along at least one of the hemmed sides, holes are preferably, but not necessarily, placed in intervals (e.g. every foot) to allow the use of zip ties at multiple heights (see, e.g. FIG. 6). The other hemmed side may likewise have holes.

The universal framing unit also doubles as the framing tracks or plates for itself for framing (i.e. the universal framing unit can be both a framing stud and a framing plate for universal framing).

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein:

FIG. 6 provides a perspective and a top view of a wall in cutaway illustrating how the present universal framing unit can create finished walls that are sound proof and still able to accommodate the running of wiring through the wall according to the principles of the present invention;

Like reference numerals indicate the same or similar parts throughout the several figures.

Figure 1A:
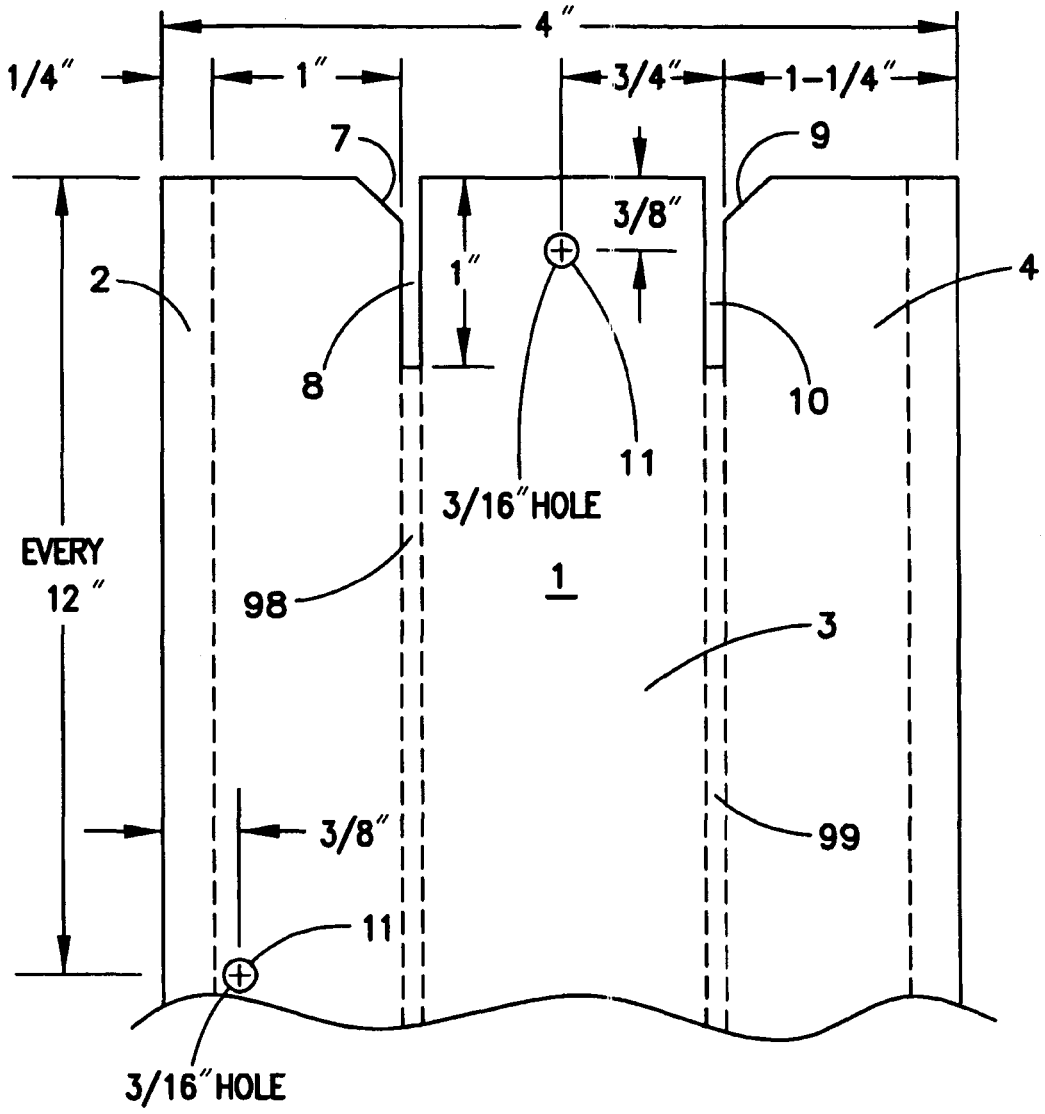
FIGS. 1A-C provides a blue print type view of the present universal framing unit illustrating a cut but unfolded piece of metal stock for forming a universal framing unit (FIG. 1A), a portion of a fabricated universal framing unit (FIG. 1B), and a portion of wall framing using the present universal framing units as a framing stud and a framing plate (FIG. 1C)

A detailed description of the features, functions and/or configuration of the components depicted in the various figures will now be presented. It should be appreciated, however, that not all of the features of the components of the figures may be necessarily described in detail. Some of these non discussed features as well as discussed features are inherent from the figures. Other non discussed features may be inherent in component geometry and/or configuration.

DESCRIPTION OF THE PREFERRED EMBODIMENT

For the purpose of promoting an understanding of the principles of the invention, reference will now be made to the embodiment illustrated herein and specific language will be used to describe the same. It will nevertheless be understood that no limitation of scope of the invention is thereby intended, such alterations, modifications, and further applications of the principles of the invention being contemplated as would occur to one skilled in the art to which the invention relates.

A multitude of framing and/or bracing jobs are solved by having the present universal framing/bracing (collectively, framing) unit on the job site. A framing system utilizing the universal framing unit includes just one type of unit that doubles as a stud and as a plate or track—i.e. the present universal framing unit. The universal framing unit has two flanged sides with mended edges and slots at each end that provides connection to a base plate. These slots are used to interlock the universal framing units as studs over the universal framing units as plates. At each end of the universal stud/plate is a hole pre-drilled to make attachment of the universal stud/plate to one another with ease and to create tight joints. Along one of the flanged sides pre-drilled holes are placed/situated every certain interval such as 12" for ease of attachment of pipes and the like and wires (see, e.g. FIGS. 1 and 4).

When the universal framing units as studs are used with either a universal framing units as a plate or a standard plate, there is a dead air space created within the walls and no studs touching both inner sides of the walls. This both creates a chase in every wall to run wires, pipes, conduit and/or the like and with the dead air space forms a block for sound to travel in between the two walls (see, e.g. FIG. 2).

The present universal framing unit provides easy construction and method of creation of curved frames and/or bracing with the universal framing unit either horizontally (laterally), vertically or both. To curve a wall horizontally, the universal framing units that are to be used for the plates are placed on the floor next to the desired curve drawn on the floor. The plate is cut more often if the curve is sharper and less for longer bends. For every needed bend in the bottom plate, a ¼" piece of one of the sides is removed and the bottom is cut to the far side. The far side that was not cut is bent to match the curve. The top plate is cut to match the bottom plate but in the mirror image. The universal framing units as studs are placed with one or more thereof purely flat on and with respect to the plates. To curve the vertical walls, simply cut both sides of the universal framing stud opposite each other and bend the stud to match the desired curve (see, e.g. FIGS. 3 and 3*a*).

The present universal framing unit provides ease of use in conjunction with a standard dimensioned "C" stud and its plate. Because in one form the universal framing unit is only 1" deep and the plate is 3½" deep, in applications where walls are desired on adjacent sides of the standard "C" framing, the use of two universal framing studs still leaves a 1½" distance between the edges of the lateral sides of the universal framing studs and the front faces (or interior wall surfaces) through which pipes, wires and the like can be run. This space or area can also provide sound proofing as well as provide other attributes and/or uses.

The present invention provides ease of which the universal framing unit can be cut, bent and re-enforced to make framing and/or bracing for walls. Because the sides of the present universal framing unit are hemmed, they allow for the universal framing unit as studs to be cut much easier than standard "C" studs can be cut and is much smaller allowing framing/bracing to be fit into cramped areas (see, e.g. FIG. 5).

The present universal framing unit can create a soundproof wall, can run wire through it, and does it all within 2½" with finished ½" drywall on both sides. The universal framing unit/stud/track or plate is only 1" deep and as long as the studs are not placed opposite each other, the void area is ½". The ½" area becomes dead air space and the chase for wiring.

In accordance with the principles of the present invention, a universal framing unit wall can be assembled on the floor and raised up, assembled with tracks/plates in place first, and in cramped areas. It also can be expanded to meet ceilings to make tight walls in between ceilings and floors. The way that the present universal framing unit as a stud slides over the universal framing units as a plate to allow the universal framing studs to stay in one spot and they only need to be screwed together when the wall is in place. Moreover, because the universal framing stud slides over the plate, the universal framing studs can be raised up before they are screwed together; thus expanding the whole wall (see, e.g. FIG. 7).

In accordance with the principles of the present invention, the universal framing unit can be used to create walls to fur out next to walls, fur around pipes, create chases in walls, and create walls that have two different profiles from one side to the other side. Because the depth of the universal framing unit as a stud is just 1½" instead of the typical 3½" stud, floor space is usable that would normally be lost under the wall (see, e.g. FIGS. 8-9). The same thing can be said for the furing out of pipe chases or anything that has to alter the wall (see, e.g. FIGS. 8-10). Where chases are required to house pipes, ducts or structural framing with the finished walls, the present universal framing stud wall can be placed on each side of the chase (see, e.g. FIGS. 8-11). Because the walls are looked at from one side at a time—not both like the normal "C" stud wall, the configuration of the wall shape on one side can be different from the other side. As an example, one room could have rounded corners when the room next to it could have square corners (see, e.g. FIGS. 8-12).

In accordance with the principles of the present invention, the universal framing unit can be cut easily, fabricated and/or ordered in specific lengths for things such as creating bulkheads. Also, the universal framing unit's ability to connect to itself makes it easy to create long walls or bulkheads that interlock without special bracketing. When creating a shorter wall or bulkhead, the universal framing unit as a stud is cut to length and the original end is slid over the plate with desired spacing. The other cut end is slid under the top plate or if ordered to length, slid over the plate with the slot and screwed off or fastened (see, e.g. FIGS. 9-10). The short wall or bulkhead is ready to be installed and can be done by one workman because of the lightweight nature of the system. Adding new walls and bulkheads to the installed units is much easier to do than the standard "C" stud. To attach two universal framing units as plates together, simply cut off an angle of one corner of the back (see, e.g. FIG. 10) so that it slides easily inside the end of the other plate to which it is to be attached. Both of the sides of the cut plate slide over the outside of the sides of the second plate while the sides of the second plate go inside of the cut plate (see, e.g. FIG. 10). Finally, a screw would be installed through the hole in the second plate into the cut plate. Screws are also installed through the cut plate's sides into the second plate.

Figure 1B:
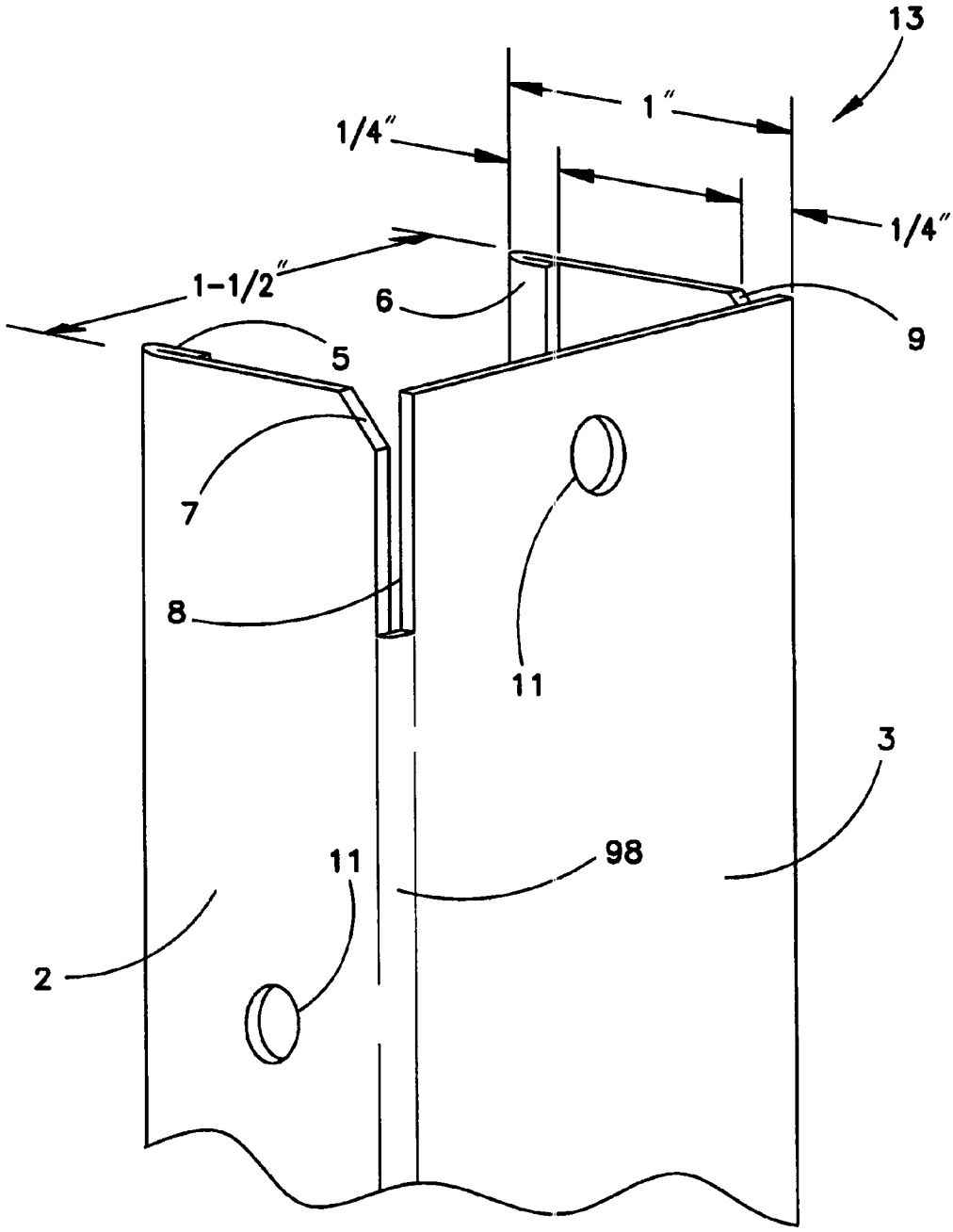
Figure 1C:
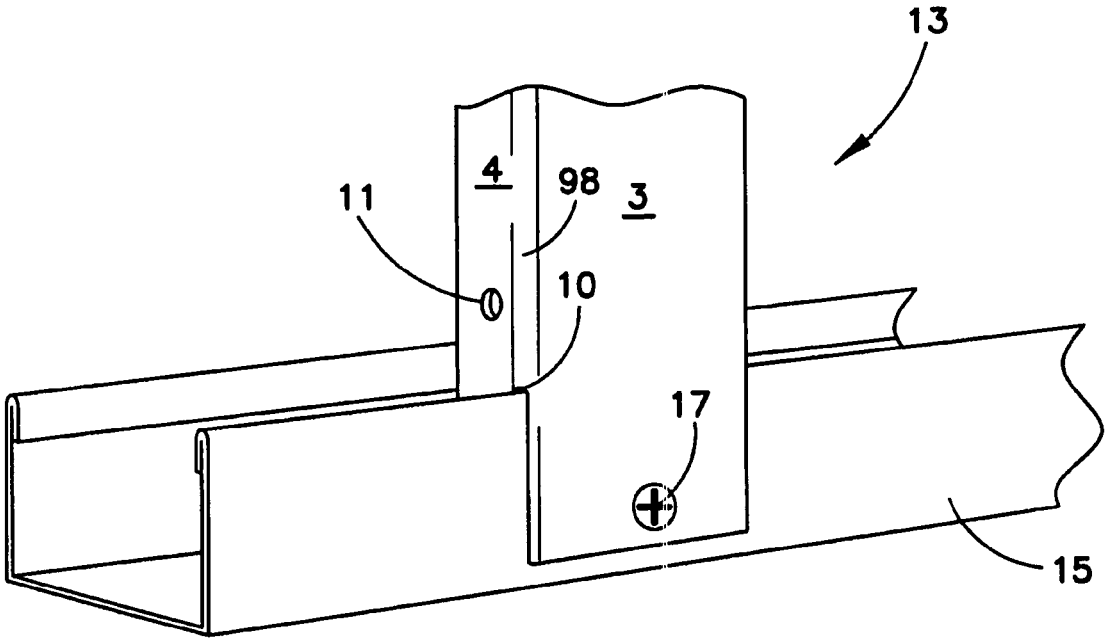

Referring in particular to FIG. 1, there is depicted several subfigures labeled A, B and C that show the present universal framing units as a stud, plate, track, framing, bracing, and/or construction unit. In subfigure A there is shown a solid metal blank or length of metal 1 used to form a solid metal length of the present universal framing unit, generally designated 13. The metal blank 1 is preferably of a suitable metal such as steel, aluminum or an alloy. Other materials, however, may be used. The blank 1 is shown defining three walls or sides, namely a front wall or side 3, a first lateral wall or side 2, and a second lateral wall or side 4. The first and second lateral walls 2, 4 are thus integral or part of the front wall 3. The preferred dimensions of which are presented above. However, the present framing unit may have dimensions that are different than the preferred dimensions. The front wall 3 serves as front plate when the universal framing unit is a stud and as a bottom plate when the universal framing unit is a track.

As shown in FIG. 1B, the blank 1 has been shaped to form the universal framing unit 13. Particularly, the blank 1 as illustrated in FIG. 1A has been shaped by bending the first lateral wall 2 from one side of the front wall 1 along the double dashed lines so as to form a first bend, curved or arched transition 98, and by bending the second lateral wall 4 from another side of the front wall 1 along the double dashed lines so as to form a second bend, curved or arched transition 99. The first and second lateral walls 2, 4 are generally perpendicular to the front wall 1.

A slot 8 is disposed in the first bend or curved transition 98 between the first lateral wall 2 and the front wall 3 and extends a distance corresponding roughly to the height of a track side of a track embodiment (15) of the present universal framing unit from an end of the unit. Here the slot distance is 1", but may be more or less as desired. The end of the lateral wall 2 is preferably, but not necessarily, clipped, cut or notched on a slant to provide an angle 7. This provides a wider opening to the slot 8 proximate the end of the unit than distal the end of the unit. The first slot 8 thus spans between the front wall 1 and the first lateral wall 2 since the first slot 8 is in the corner (in the curved transition 98) between the front and first lateral walls 1, 2. In like manner, a slot 10 is disposed in the second bend or curved transition 99 between the second lateral wall 4 and the front wall 3 and extends a distance corresponding roughly to the height of a track side of a track embodiment (15) of the present universal framing unit from an end of the unit. Here the slot distance is 1", but may be more or less as desired. The end of the lateral wall 4 is preferably, but not necessarily, clipped, cut or notched on a slant to provide an angle 9. This provides a wider opening to the slot 10 proximate the end of the unit than distal the end of the unit. The second slot 10 thus spans between the front wall 1 and the second lateral wall 4 since the second slot 10 is in the corner (in the curved transition 99) between the front and second lateral walls 1, 4. Preferably, but not necessarily, both ends of the framing unit 13 are configured in this manner.

Various holes 11 as set forth herein are provided in the walls 2, 3, 4 of the universal framing unit 13. Additionally, the edge of the wall 2 includes a mend or hem 5 (i.e. is folded over), while the edge of the wall 4 also includes a mend or hem 6 (i.e. is folded over).

Subfigure B shows the universal framing unit 13 formed from the bending or folding of the configured blank 1. The universal framing unit 13 thus defines a three-sided or walled rectangular conduit or frame member. Subfigure C shows the universal framing unit as a stud 13 situated on a universal framing unit as a track 15. The track 15 includes all of the features of the present universal framing unit at one or both of its ends or may be considered a modified universal framing unit with only one of its ends the same. The universal framing unit as the stud 13 is situated onto the edge of the universal framing unit as the track 15 by having the slots 8 and 10 receive the edge of the track 15 whereby an end portion of the front side 3 is outside of the track side and is secured thereto via a screw 17 or other fastening device. The walls 4 and 2 extend only a portion of the depth of the track such that a space is defined between the edges 5, 6 of the lateral walls 2, 4 of the stud 13.

Figure 2:
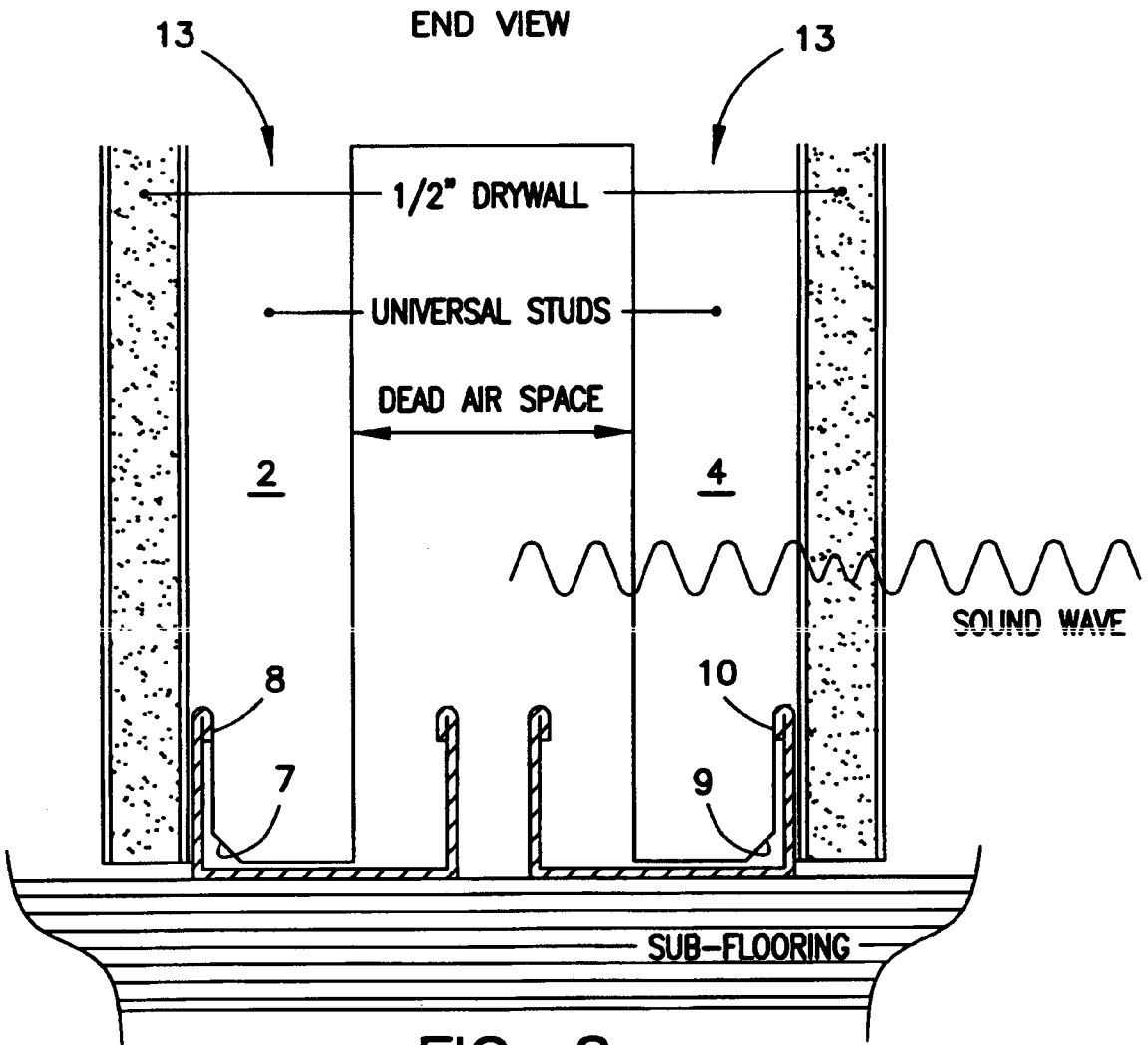
FIG. 2 is a cross-sectional view of a typical universal framing unit (stud/plate) wall made by using two of the present universal framing units particularly illustrating how the stud on one side does not traverse to the other side thus creating a dead air space in accordance with the principles of the present invention.

FIG. 2 depicts an end view of a wall created by two universal framing units as studs 13 on two universal framing units as tracks 15. FIG. 2 illustrates how the universal framing units as studs create a dead air space between the installed drywall to create sound proofing.

Figure 3:
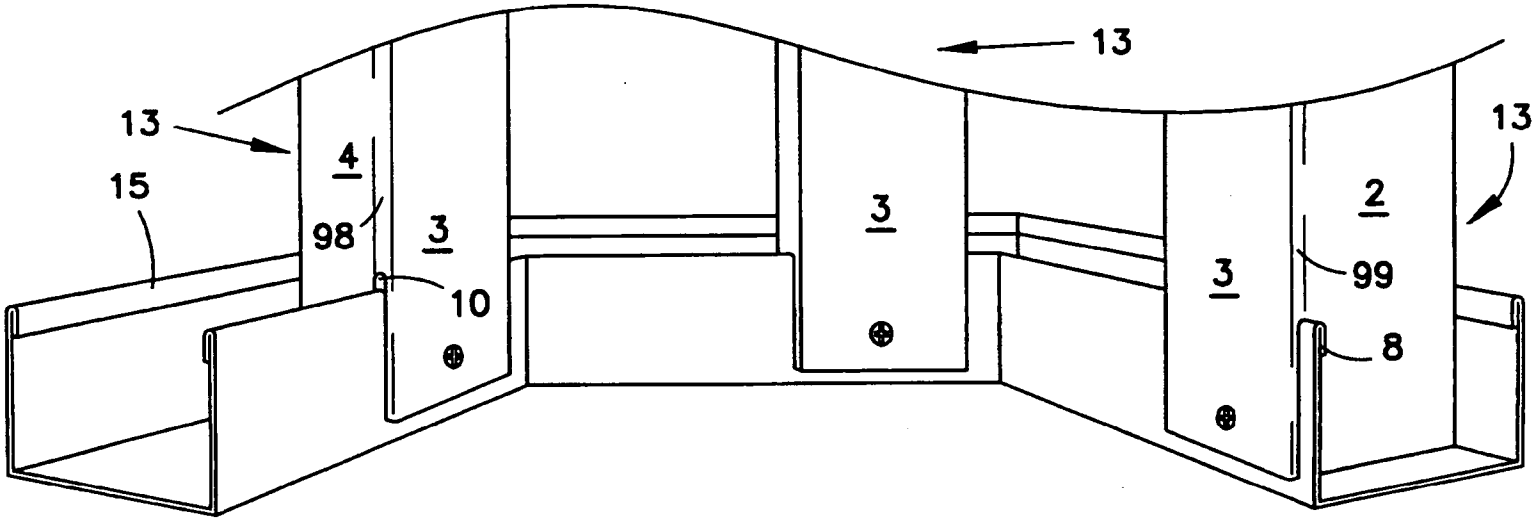
FIGS. 3 and 3A are perspective views illustrating how to curve the present universal framing unit and a manner of creating various framing configurations.
Figure 3:
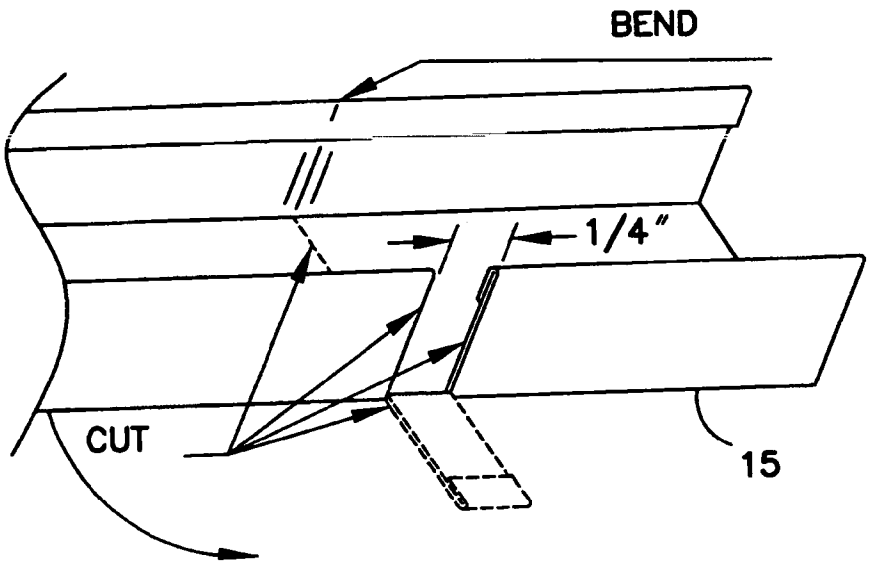
Figure 3A:
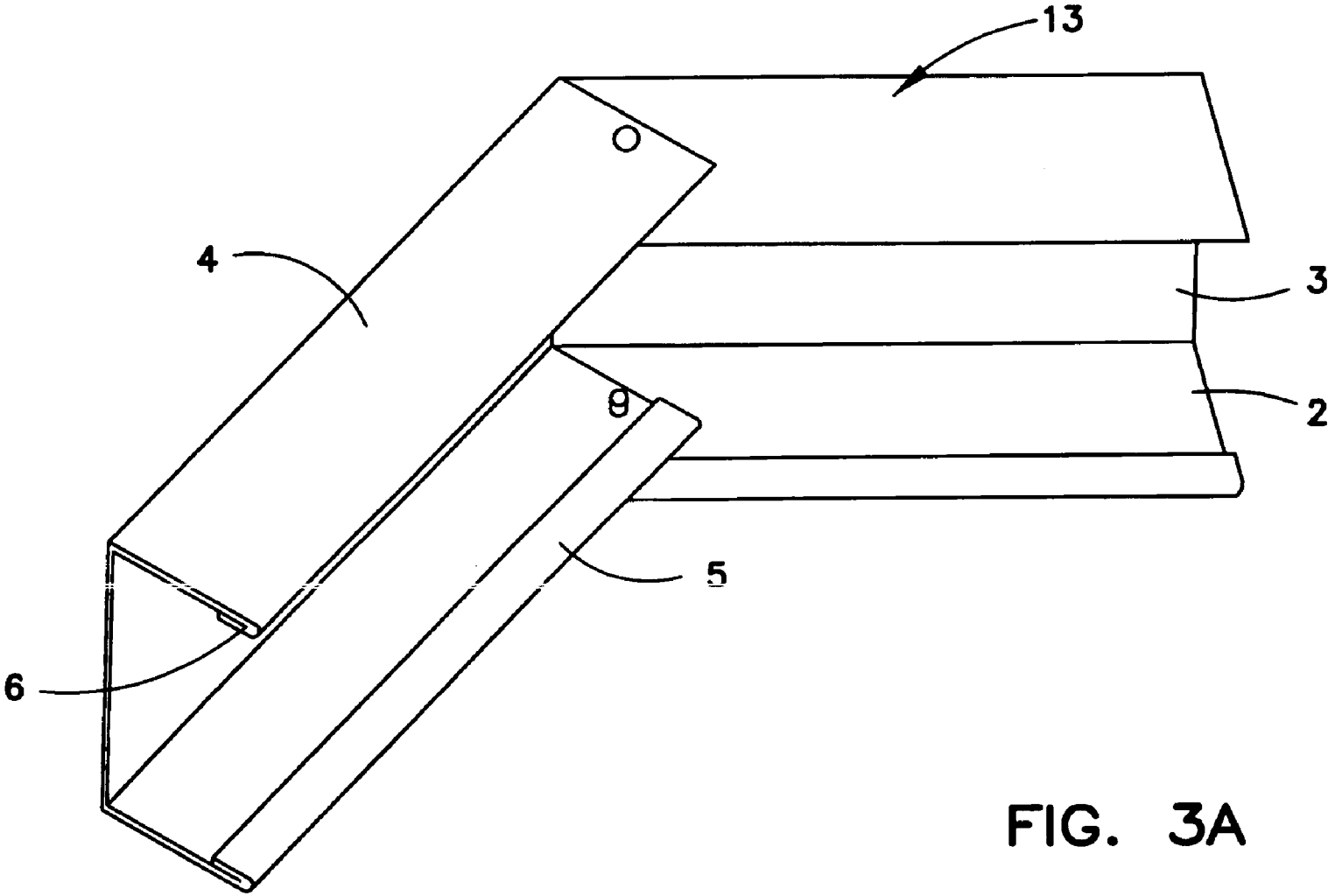

FIG. 3 depicts the manner in which corners, curves or bends are created using the present universal framing unit 13. Particularly, it is shown how a curve or bend is created in the universal framing unit as a track 15 and then how the various universal framing units as studs 13 can be situated on the track 15. FIG. 3*a* depicts various subfigures A, B and C that illustrate further manners of curved or bent framing/bracing created using the present universal framing unit.

Figure 4:
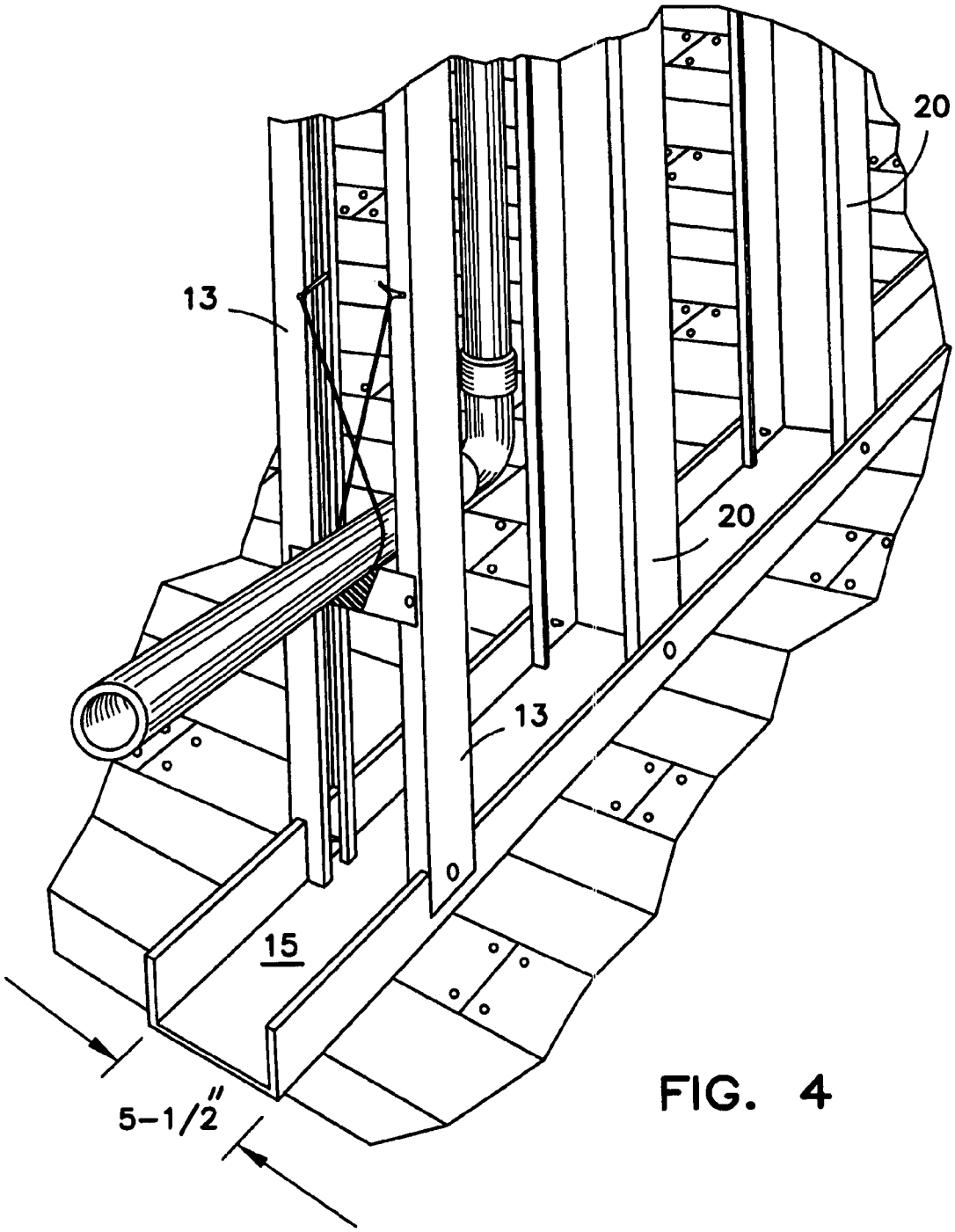
FIG. 4 is a perspective view of a wall formed by standard "C" studs and the universal framing unit as a stud illustrating how the present universal framing unit can be used with standard "C" stud wall framing, particularly with respect to accommodating plumbing and/or conduit.

FIG. 4 illustrates how the present universal framing unit 13 may be used with conventional "C" studs 20. Since two universal framing units as studs 13 create an open space between themselves, there is no need to drill or create cutouts to accommodate piping (as shown) or other in-the-wall components. The piping is shown being held with ties and with a brace connected between the lateral sides of the stud 13.

Figure 5:
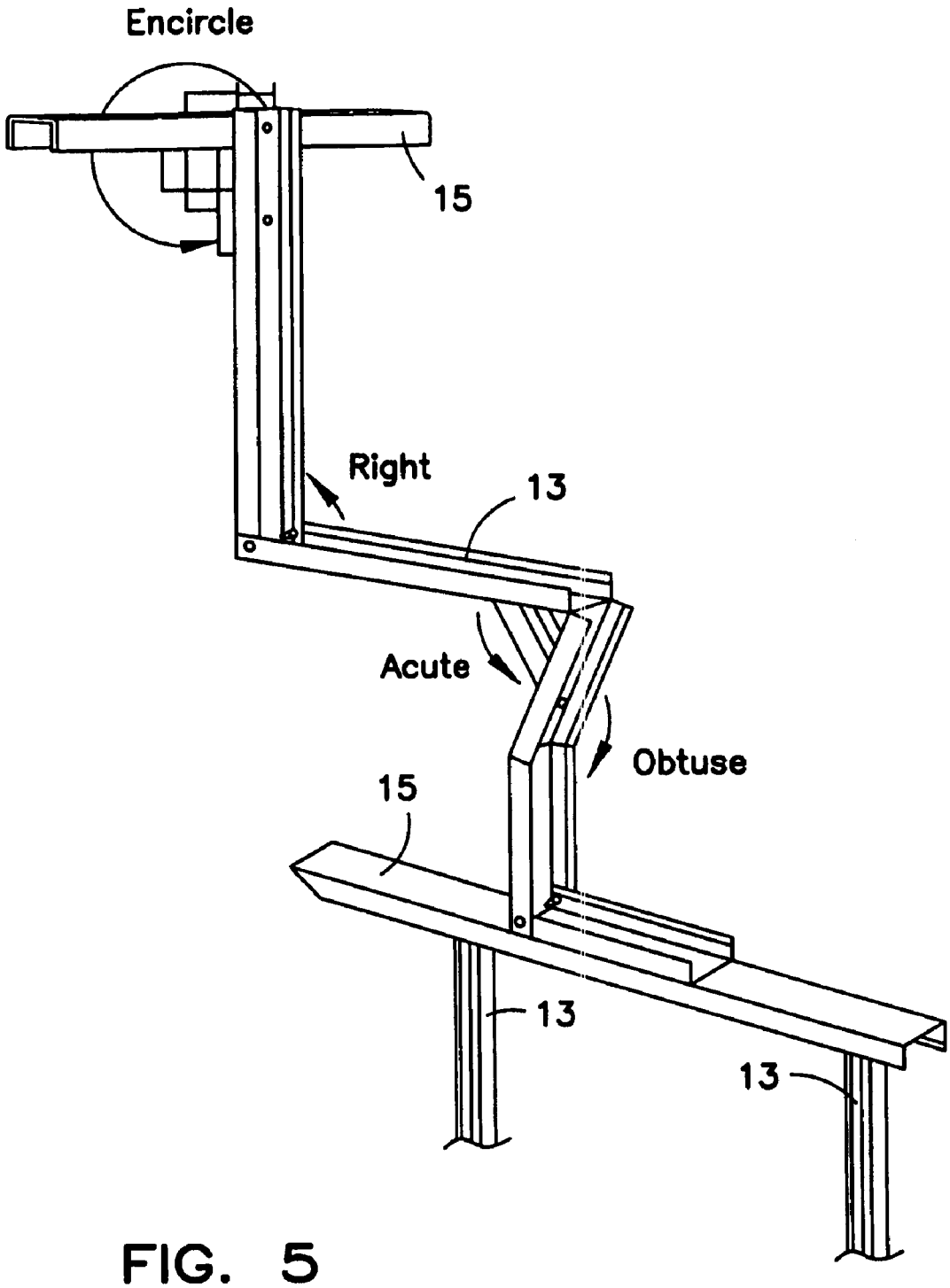
FIG. 5 is a perspective view illustrating how the present universal framing unit can be easily converted into any kind of bracing in accordance with the principles of the present invention.

FIG. 5 illustrates a manner of use, bracing or framing that is achievable using the present universal framing unit 13. Particularly, FIG. 5 illustrates how the present universal framing unit 13 may be bent to form a complex frame. Right angles, obtuse angles and encircling are shown as achievable results.

FIG. 6 illustrates how wiring is easily run in a wall constructed using the present universal framing unit as a stud 13. As best seen in the top view of FIG. 13, the wiring runs in the space or area defined in the open space depth between the wall and the end of the sides 2, 4 of the stud 13.

Figure 7:
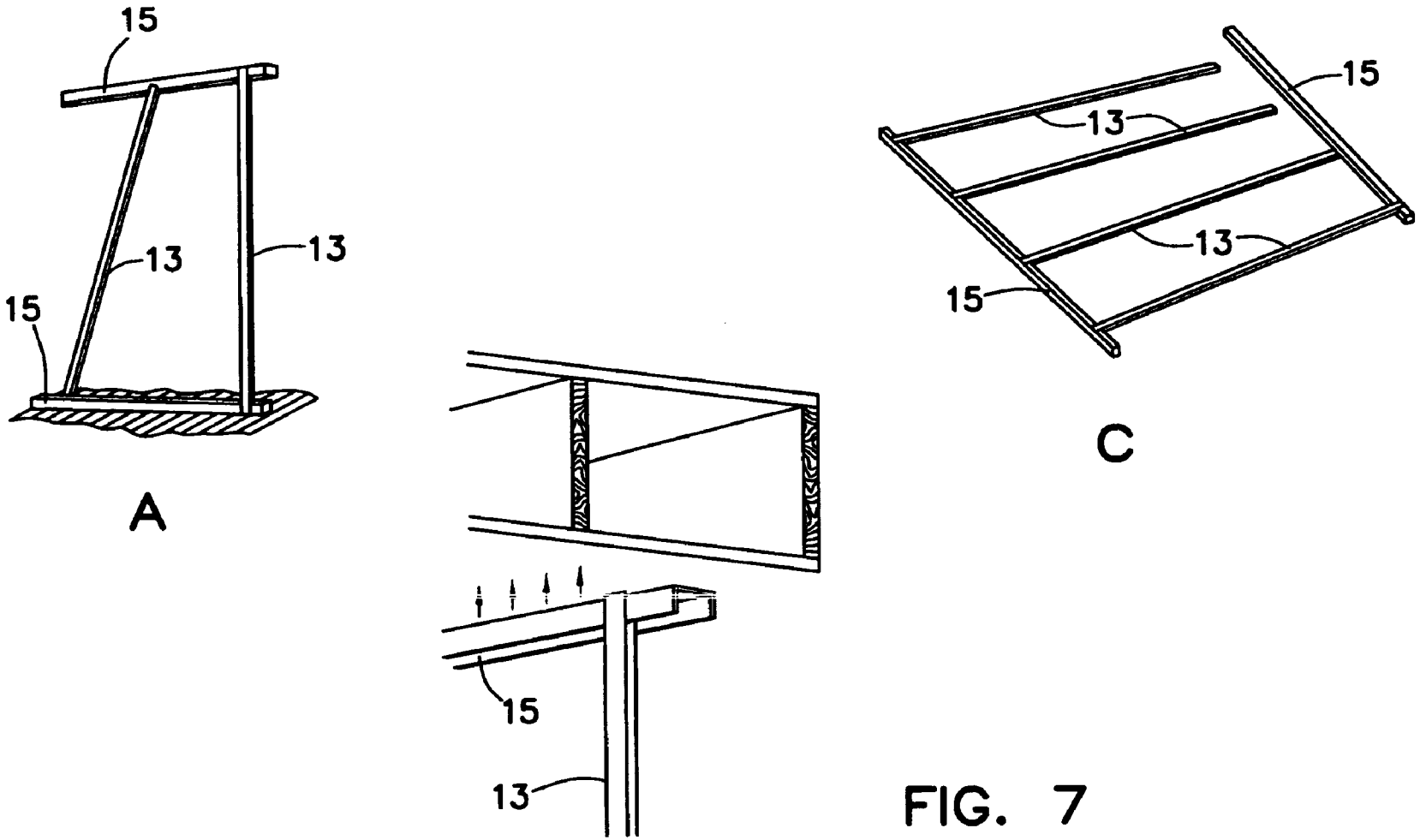
FIGS. 7A-C provide various figures illustrating a procedure to construct a universal framing stud wall (framing) and how to expand walls to meet ceilings using the present universal framing unit in accordance with the principles of the present invention.

FIG. 7 depicts several subfigures showing a manner in which framing may be constructed in accordance with the principles of the present invention, utilizing the present universal framing unit 13. Subfigure A depicts how the present universal framing unit as a stud 13 can be angled (off vertical) or be set vertical relative to two universal framing unit as tracks 15. Subfigure B illustrates how the present universal framing unit may be used to frame around or along a construction component. Subfigure C illustrates how a wall may be constructed before setting it up utilizing the preset universal framing unit.

Figure 8:
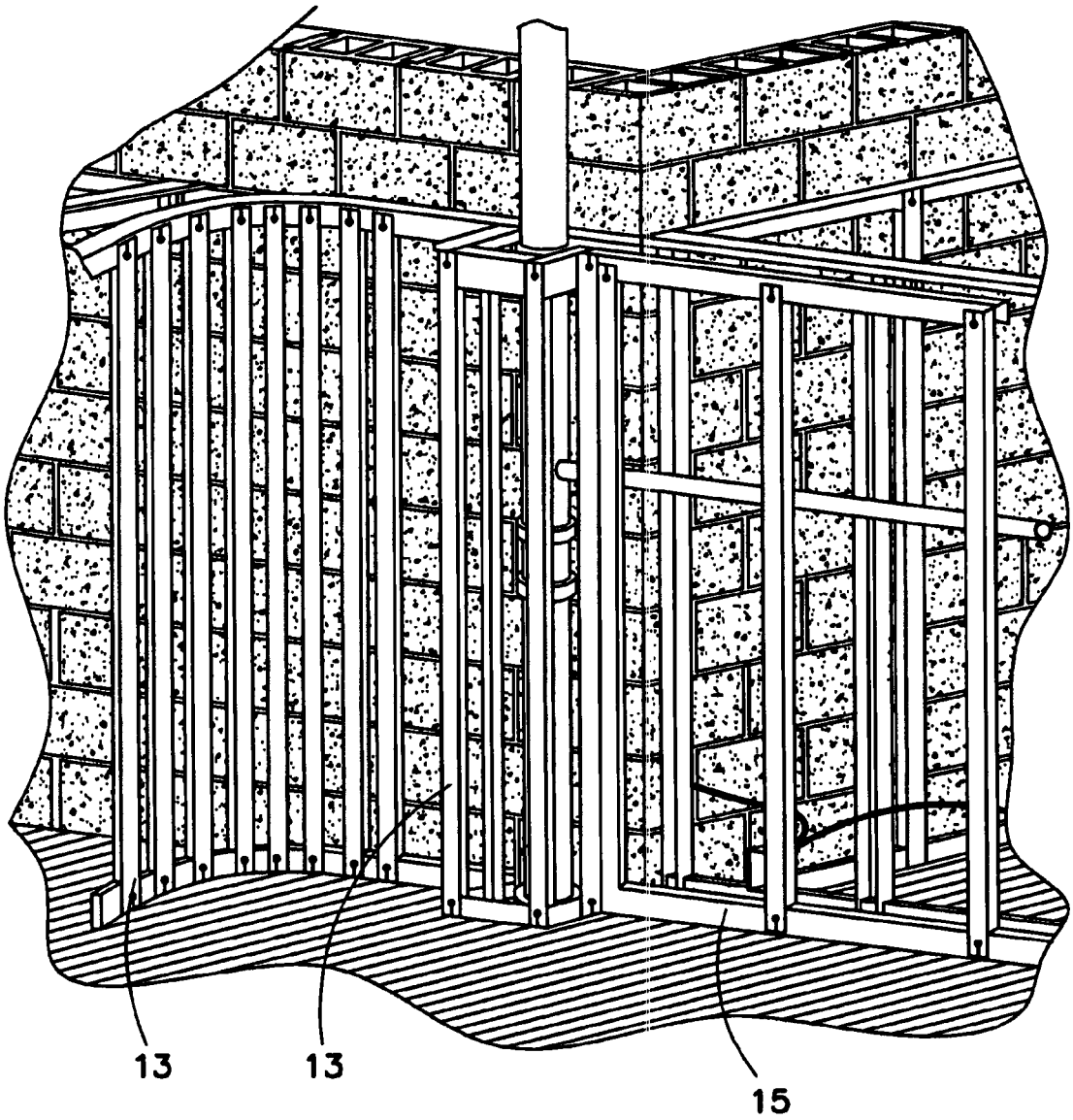
FIG. 8 is a perspective view of wall framing using the present universal framing unit particularly illustrating several types of uses of the universal framing unit such as for furring out walls that are straight and/or curved, boxing out pipe chases (or other structures), typical walls, and the same wall having different profiles on each side in accordance with the principles of the present invention.
Figure 9:
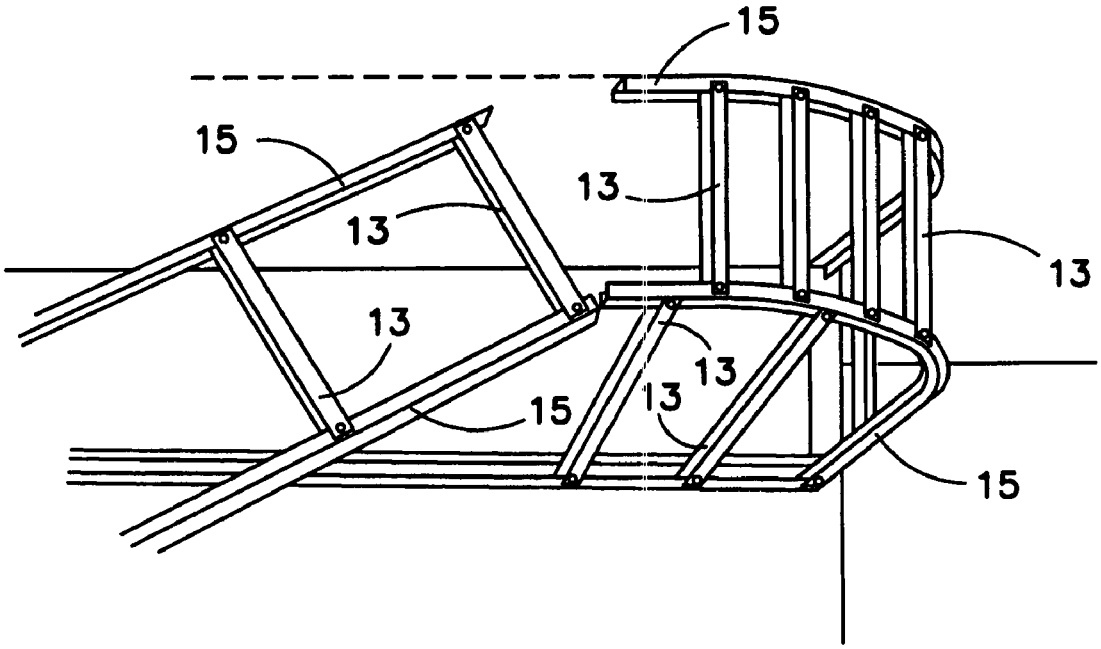
FIG. 9 is a perspective view of a complex bulkhead configuration made and made simple by the present universal framing unit.

FIG. 8 shows various framing and/or bracing structures achievable with the present universal framing unit 13. The present universal framing unit as a stud 13 frames out around pipes, allows wiring within drilling holes and the running of conduit. Moreover, the present universal framing unit 13 allows for bends or curves and can accommodate walls of different configuration on either side of the walls formed by the present universal framing unit 13. FIG. 9 depicts a bulkhead being framed using the present universal framing unit 13.

Figure 10:
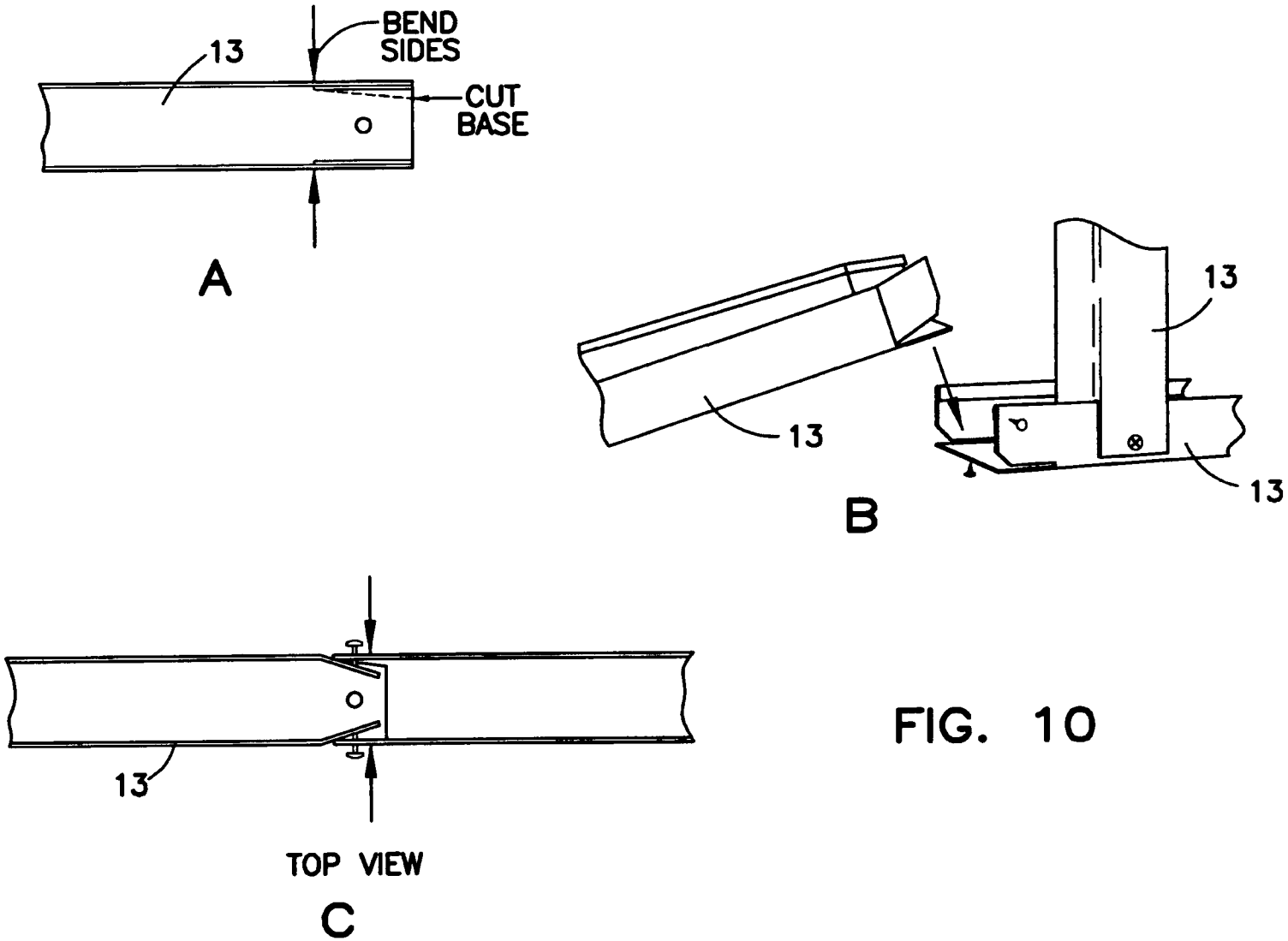
FIGS. 10A-C provides various figures illustrating a manner of mending plates by putting the present universal framing unit (FIG. 10A) together, wherein the perspective view (FIG. 10B) shows the cut to tallow the back to slide inside the other plate, and the top view (FIG. 10C) shows how the sides of the plates are interlocked together and where the screws are installed in accordance with the principles of the present invention.

FIG. 10 depicts several subfigures A, B and C that illustrate how two universal framing units 13 as tracks, may be connected to one another. It can be seen that the ends of the sides are first bent inward. The bent track is then received in another track. Thereafter, the tracks are fastened to one another.

Figure 11:
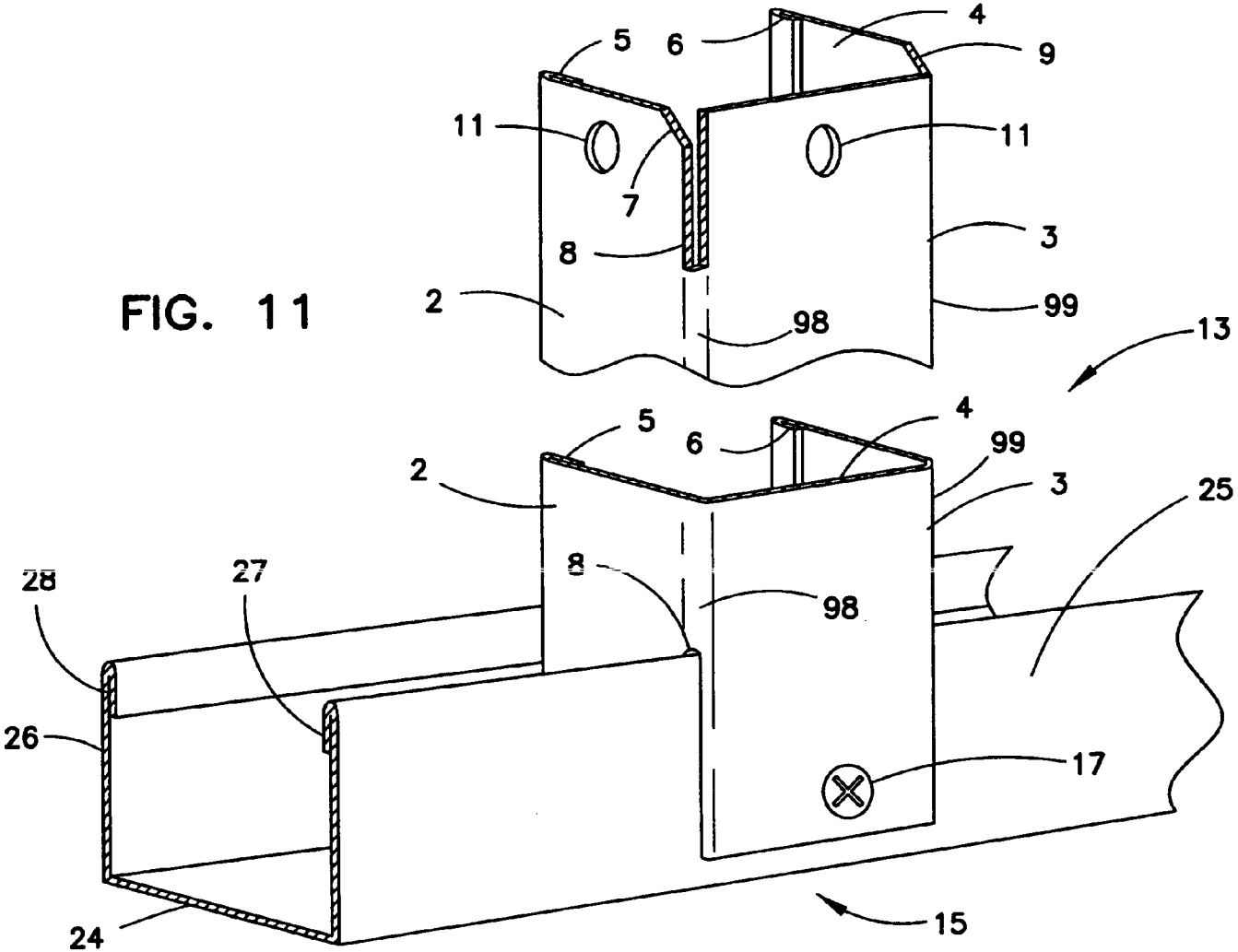
FIG. 11 is a perspective view of upper and lower portions of a universal framing unit as a stud installed on a universal framing unit as a track for framing.

FIG. 11 shows the upper and lower parts of the universal framing unit as a stud 13 situated on a track 15, the track 15 being a typical track with regards to dimension. The stud 13 is situated onto the edge of the track 15 by having the slots 8 and 11 receive the side/edge 25/27 and side/edge 26/28 of the track 15 whereby an end flange of the front side 3 of the stud 13 is outside of the track side 25 and is secured thereto via a screw 17 or other fastening device. The sides 4 and 2 extend only a portion of the depth of the track such that a space is defined between the edges 5, 6 of the lateral sides 2, 4 of the stud 13 (see space 40 of FIG. 13 that corresponds thereto).

Figure 12:
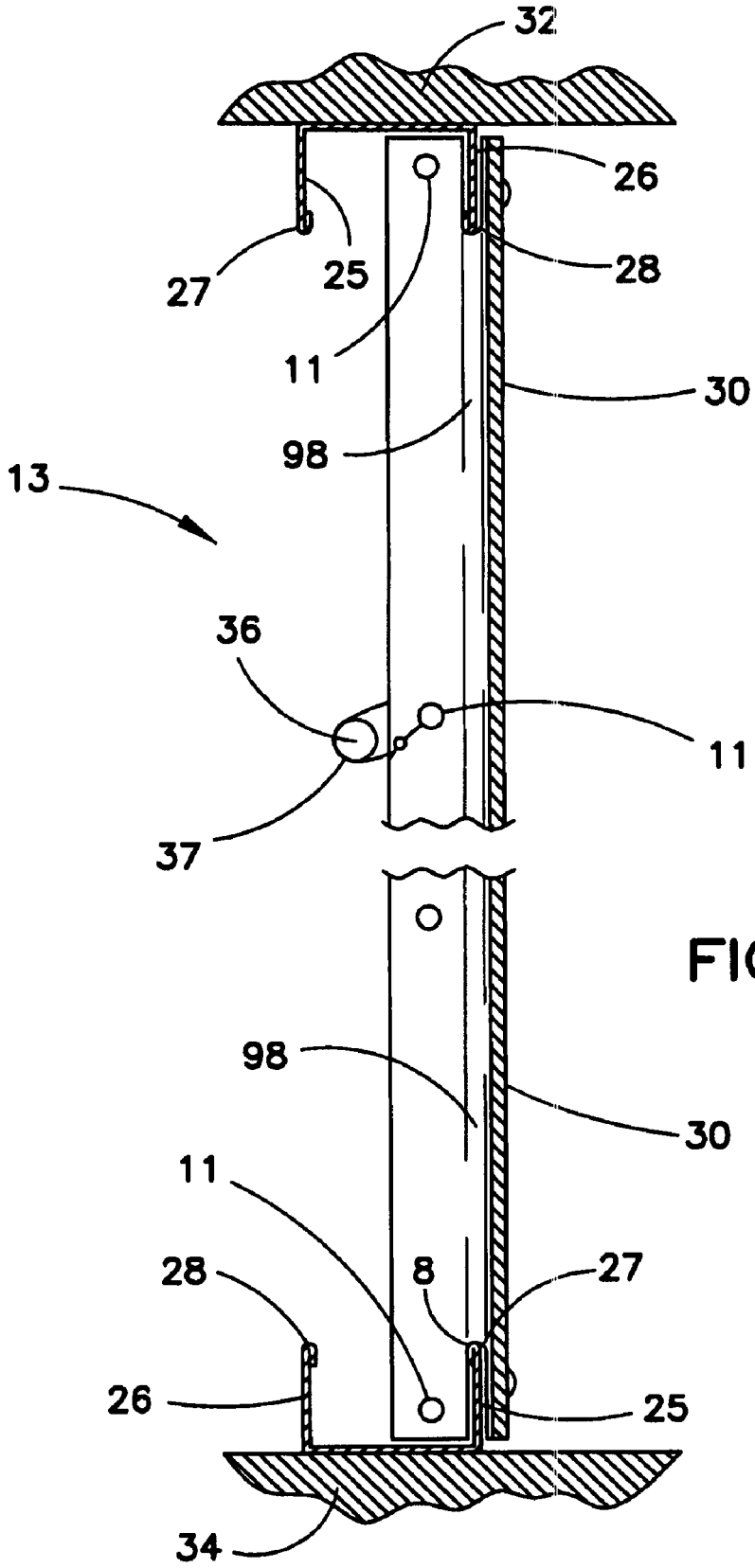
FIG. 12 is a side sectional view of a wall made between a ceiling and a floor using the present universal framing unit as a framing plate and as a framing stud, the figure showing a pipe or conduit tied to the framing stud.
Figure 13:
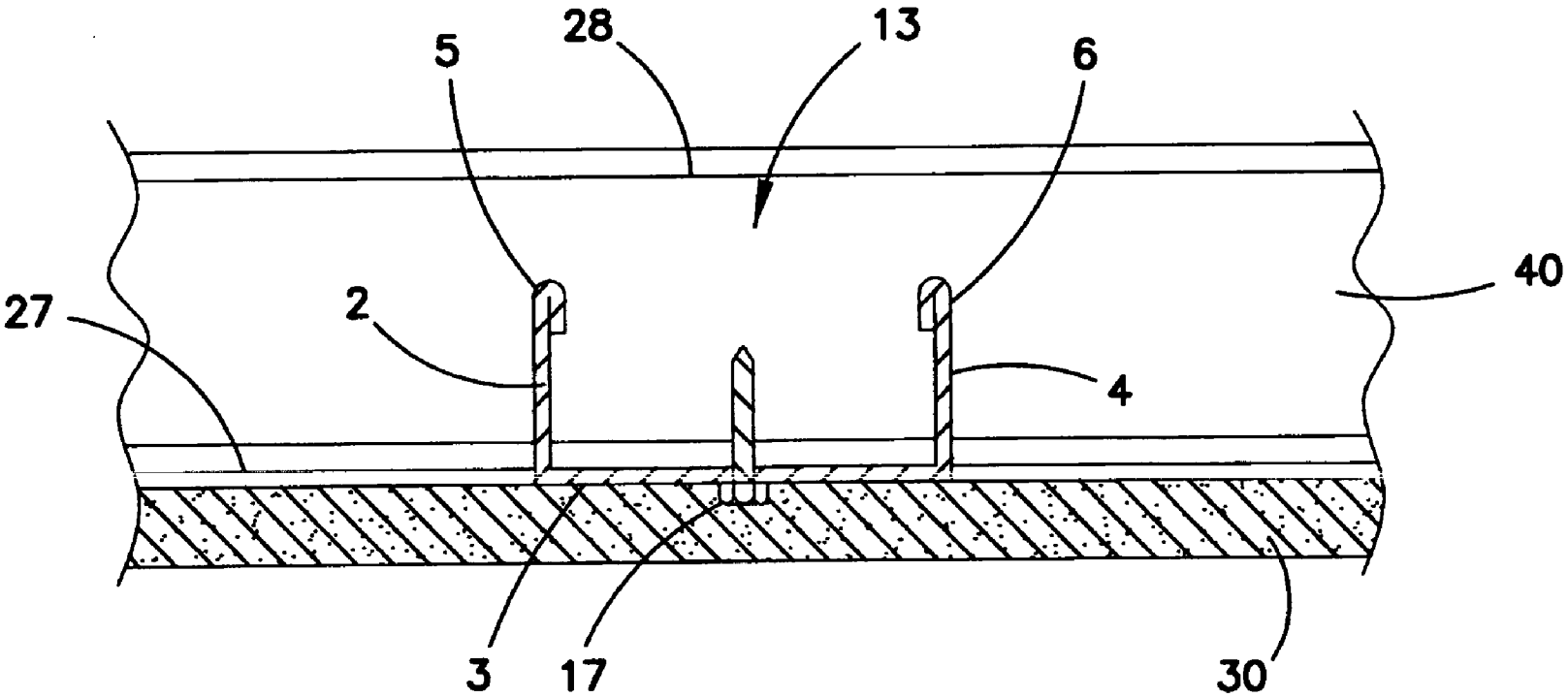
FIG. 13 is a top sectional view of the wall of FIG. 12 taken along the midpoint of FIG. 12.

FIGS. 12 and 13 show the universal framing unit as a stud 13 situated between the ceiling 32 and the floor 34. In FIG. 12, a conduit or pipe 36 is shown attached to the stud 13 by a tie 37 that extends though holes 11 in the stud 13. FIG. 12 also shows drywall 30 situated on the front, face or plate 3 of the stud 13 to form a wall on that particular side. A space or area exists from the floor 34 (i.e. the bottom 24 of the track 15) and the ceiling 32 (i.e. the bottom 24 of track 15).

While the invention has been illustrated and described in detail in the drawings and foregoing description, the same is to be considered as illustrative and not restrictive in character, it being understood that preferred embodiments have been shown and described and that all changes and modifications that come within the spirit of the invention are desired to be protected.

What is claimed is:

1. A unit for framing a building as a framing stud and a framing track, the framing unit comprising:

a solid length of metal defining a front wall, a first lateral wall and a second lateral wall, the first lateral wall continuous with a first lateral side of the front wall via a first curved transition, the first lateral wall perpendicular to the front wall, the second lateral wall continuous with a second lateral side of the front wall via a second curved transition, the second lateral wall perpendicular to the front wall;

a first slot formed in the first curved transition from a first end of the solid length of metal and extending a first length along the first curved transition, the first slot having a width equal to a width of the first curved transition as measured from the first lateral side of the front wall to the first lateral wall; and a second slot formed in the second curved transition from the first end of the solid length of metal and extending a second length along the second curved transition, the second slot having a width equal to a width of the second curved transition as measured from the second lateral side of the front wall to the second lateral wall.

2. The framing unit of claim 1, wherein the first and second slot lengths are equal.

3. The framing unit of claim 1, wherein the first and second lateral walls are perpendicular to the front wall.

4. The framing unit claim 1, wherein the first lateral wall has a first plurality of holes and the second lateral wall has a second plurality of holes.

5. The framing unit of claim 4, wherein the first plurality of holes is situated at first intervals along the first lateral wall, and the second plurality of holes is situated at second intervals along the second lateral wall.

6. The framing unit of claim 5, wherein the first intervals comprise a hole every 12" starting from an end of the first lateral wall, and the second intervals comprise a hole every 12" starting from an end of the second lateral wall.

7. The framing unit of claim 1, wherein the first lateral wall extends 1" from the first transition, the second lateral wall extends 1" from the second transition, and the front side has a width of 1½".

8. The framing unit of claim 1, wherein the first slot is wider proximate the first end of the solid length of metal than distal the first end of the solid length of metal, and the second slot is wider proximate the first end of the solid length of metal than distal the first end of the solid length of metal.

9. The framing unit of claim 1, further comprising:

a third slot formed in the first curved transition from a second end of the solid length of metal and extending a third length along the first curved transition; and a fourth slot formed in the second curved transition from the second end of the solid length of metal and extending a fourth length along the second curved transition.

10. The framing unit of claim 9, wherein the first, second, third and fourth slot lengths are equal.

11. The framing unit of claim 1, wherein the solid length of metal comprises a solid length of steel.

12. A unit for framing a building as a framing stud and framing track, the framing unit comprising:

a solid length of metal defining a front wall, a first lateral wall and a second lateral wall, the first lateral wall continuous with a first lateral side of the front wall via a first curved transition, the first lateral wall perpendicular to the front wall, the second lateral wall continuous with a second lateral side of the front wall via a second curved transition, the second lateral wall perpendicular to the front wall;

a first slot formed in the first curved transition from a first end of the solid length of metal and extending a first length along the first curved transition, the first slot having a width equal to a width of the first curved transition as measured from the first lateral side of the front wall to the first lateral wall a first notch extending from a first end of the first lateral wall to the first slot;

a second slot formed in the second curved transition from the first end of the solid length of metal and extending a second length along the second curved transition, the second slot having a width equal to a width of the second curved transition as measured from the second lateral side of the front wall to the second lateral wall; and a second notch extending from a first end of the second lateral wall to the second slot.

13. The framing unit of claim 12, wherein the first and second slot lengths are equal.

14. The framing unit of claim 12, wherein the first and second lateral walls are perpendicular to the front wall.

15. The framing unit of claim 12, wherein the first lateral wall has a first plurality of holes and the second lateral wall has a second plurality of holes, the first plurality of holes situated at first intervals along the first lateral wall, and the second plurality of holes situated at second intervals along the second lateral wall.

16. The framing unit of claim 15 wherein the first intervals comprise a hole every 12" starting from an end of the first lateral wall, and the second intervals comprise a hole every 12" starting from an end of the second lateral wall.

17. The framing unit of claim 12, wherein the first lateral wall extends 1" from the first transition, the second lateral wall extends 1" from the second transition, and the front side has a width of 1½".

18. The framing unit of claim 12, further comprising:

a third slot formed in the first curved transition from a second end of the solid length of metal and extending a third length along the first curved transition;

a third notch extending from a second end of the first lateral wall to the third slot;

a fourth slot formed in the second curved transition from the second end of the solid length of metal and extending a fourth length along the second curved transition; and a fourth notch extending from a second end of the second lateral wall to the fourth slot.

19. A framing stud comprising:

a solid length of metal defining a front wall, a first lateral wall and a second lateral wall, the first lateral wall continuous with a first lateral side of the front wall via a first curved transition, the first lateral wall perpendicular to the front wall, the second lateral wall continuous with a second lateral side of the front wall via a second curved transition, the second lateral wall perpendicular to the front wall;

a first slot formed in the first curved transition from a first end of the solid length of metal and extending a first length along the first curved transition, the first slot having a width equal to a width of the first curved transition as measured from the first lateral side of the front wall to the first lateral wall;

a first notch defining a first angle from a first end of the first lateral wall to the first slot;

a second slot formed in the second curved transition from the first end of the solid length of metal and extending a second length along the second curved transition, the second slot having a width equal to a width of the second curved transition as measured from the second lateral side of the front wall to the second lateral wall;

a second notch defining a second angle from a first end of the second lateral wall to the second slot;

a third slot formed in the first curved transition from a second end of the solid length of metal and extending a third length along the first curved transition;

a third notch defining a third angle from a second end of the first lateral wall to the third slot;

a fourth slot formed in the second curved transition from the second end of the solid length of metal and extending a fourth length along the second curved transition; and a fourth notch defining a fourth angle from a second end of the second lateral wall to the fourth slot.

20. The framing stud of claim 19, wherein the first, second, third and fourth angles are all 45 degree angles.

* * * * *